United States Patent [19]

Athey

[11] Patent Number: 4,520,066

[45] Date of Patent: May 28, 1985

[54] POLYESTER FIBREFILL BLEND

[75] Inventor: Graham Athey, Harrogate, England

[73] Assignee: Imperial Chemical Industries, PLC, London, England

[21] Appl. No.: 458,012

[22] Filed: Jan. 14, 1983

[30] Foreign Application Priority Data

Mar. 8, 1982 [GB] United Kingdom ..... 8206693

[51] Int. Cl.[3] ..... D04H 1/04; D04H 1/54; D04H 1/62; D04H 1/72

[52] U.S. Cl. ..... 428/288; 428/290; 428/296; 428/297; 428/311.5; 428/317.7; 428/360; 428/362; 428/369; 428/370

[58] Field of Search ..... 428/288, 290, 296, 297, 428/369, 370, 360, 362, 311.5, 317.7

[56] References Cited

U.S. PATENT DOCUMENTS

| | | | |
|---|---|---|---|
| 2,399,259 | 4/1946 | Taylor . | |
| 2,999,296 | 9/1961 | Breen et al. . | |
| 4,068,036 | 1/1978 | Stanistreet | 428/296 |
| 4,129,675 | 12/1978 | Scott . | |

FOREIGN PATENT DOCUMENTS

| | | |
|---|---|---|
| 1168759 | 10/1969 | United Kingdom . |
| 1245437 | 9/1971 | United Kingdom . |
| 1279126 | 6/1972 | United Kingdom . |
| 1524713 | 3/1976 | United Kingdom . |
| 2050444 | 1/1981 | United Kingdom . |

OTHER PUBLICATIONS

Research Disclosure, 1975, p. 14, No. 13717.
Research Disclosure, 1971, p. 1, No. 9008.

*Primary Examiner*—James C. Cannon
*Attorney, Agent, or Firm*—Scully, Scott, Murphy & Presser

[57] ABSTRACT

A fibrefill blend comprising, and a bonded batt formed from, (a) from 90 to 50% by weight of slickened crimped hollow polyester fibre having a cavity volume of 10 to 30% and, complementally, to total 100% conjugate fibre, the hollow polyester fibres and the conjugate binding fibres having substantially the same density and decitex (and so diameter).

2 Claims, No Drawings

POLYESTER FIBREFILL BLEND

This invention relates to a polyester fibrefill blend and bonded batts produced therefrom.

Polyester fibrefill, because of its desirable insulating and aesthetic properties, is widely used in the form of a quilted batt as an interlining for clothing. Usually the polyester fibrefill is in the form of crimped staple fibre.

In general it has been considered desirable to maximise the bulk of the polyester fibrefill because this increases the thermal insulation provided by the fibrefill. This has partly been achieved by the use of hollow polyester fibres as disclosed in British Pat. Nos. 1,168,759; 1,245,437; and 1,279,126 and U.S. Pat. Nos. 2,399,259, 2,999,296 and 4,129,675 and Research Disclosure dated Oct. 11th, 1971. It has also been achieved to a certain extent by providing the polyester fibrefill with a coating of a washresistant silicone slickener, usually a polysiloxane, which stabilises the bulk of the bonded batt and also serves to inhibit fluffability.

Furthermore in British Pat. No. 1,279,126 and the Research Disclosure dated Oct. 11th, 1971, it is suggested that it is advantageous to minimise fibre movement in batts made from polyester fibrefill by treating the fibres with a resinous substance such as an acrylic resin, an acrylate or polyvinyl chloride.

It has also been suggested that the stability and handling properties of a fiberfill can be improved by including in the fiberfill, binder fibres having a lower melting point than the main fibres in the fibrefill. Research Disclosure dated September 1975 and U.S. Pat. No. 4,129,675 discloses the inclusion in polyester fibrefill of binder fibres of polyethylene terephthalate/polyethylene isophthalate which melt at a lower temperature than the polyester fibrefill. Whilst the inclusion of such fibres serves, on the application of heat, to bind the polyester fibrefill, such fibres have the disadvantage that they lose their integrity and finish up as agglomerates in the fibrefill. This causes the fibrefill to have a harsh feed and also leads to contamination of the equipment used. Also when such a fibrefill is made up into articles by stitching, there is the likelihood that imperfections will arise because of deflection of the stitching needles by the agglomerates. Furthermore the presence of agglomerates in the fibrefill restricts to some extent the reworking of the fibrefill should the need arise.

British Pat. Nos. 2,050,444 and 1,524,713 overcome these disadvantages by the use of conjugate fibres as the binder fibres, such conjugate fibres being composed of at least two fibre-forming components one of which melts at a lower temperature than the polyester fibrefill and the other which retains its fibrous integrity at the bonding temperature.

In most of the known processes for producing a bonded fibrous batt, interfibre bonding is effected by passing the unbonded batt of fibres through an oven, especially an oven through which the batt travelson a brattice, and hot air or steam is blown downwards onto the batt. This downward flow of air tends to compress the batt and consequently increases the density, and so reduces the bulk, of the bonded batt. British Pat. No. 1,524,713 attempts to overcome this disadvantage by effecting interfibre bonding by an upward rather than downward hot air stream. However, irrespective of whether an upward or downward hot air stream is used at bonding, density variations inevitably occur at carding because the denser binder fibres will tend to migrate from the less dense hollow fibres.

The present invention provides a fibrefill blend comprising (a) from 90 to 50% by weight of slickened crimped hollow polyester fibre having a cavity volume of 10 to 30% and, complementally, to total 100% by weight, (b) from 10 to 50% by weight of slickened crimped conjugate binding fibre, the hollow polyester fibres and the conjugate binding fibres having substantially the same density and decitex (and so diameter).

We also provide a bonded batt formed from a fibrefill blend of from 90 to 50% by weight of slickened crimped hollow polyester fibre having a cavity volume of 10 to 30% and from 10 to 50% by weight of slickened crimped conjugate fibre, the hollow polyester fibres and the conjugate fibres having substantially the same density and decitex.

The properties of the hollow fibres and significantly affect the quality of the batts produced from the blend of the invention. With a cavity volume of more than 30%, the high bulk elasticity of the batt decreases. This is more especially to be attributed to the fact that such filaments have a tendency to permanently deform in cross-section. On the other hand a cavity volume of less than 10% results in too low an insulation effect.

The term "conjugate fibre" refers to a fibre composed of at least two fibre-forming polymeric components arranged in distinct zones across the cross-section of the fibre and substantially continuous along the length thereof, and wherein one of the components has a softening temperature significantly lower than the softening temperature(s) of the other component(s) and is located so as to form at least a portion of the peripheral surface of the fibre. Types of conjugate fibres within this definition, for example, include those wherein a component of low melting temperature is (a) one of two components arranged side by side, or (b) forms a sheath about another component serving as a core, or (c) forms one or more lobes of a multilobal fibre. Fibres in which the polymeric components are asymmetrically arranged in the cross section thereof are potentially crimpable in that they tend to develop crimp when subjected to a heat treatment. In contrast, fibres in which the polymeric components are symmetrically arranged do not have a propensity to crimp and must therefore be crimped by a mechanical method such as, for example, stuffer box crimping.

The hollow and conjugate fibres can be produced by methods known per se. The hollow fibres by spinning the polyester, usually polyethylene terephthalate, through a hollow filament spinneret, drawing the hollow filament, crimping the hollow filament by compression and heat setting and cutting the filament to the required staple length. The conjugate fibres by spinning the two fibre components, through a heterofilament pack and spinneret, drawing the heterofilament so formed, crimping the heterofilament by compression and heat setting and cutting the filament to the required staple length.

No alterations in the usual working conditions are necessary.

The staple length of the polyester fibrefill and of th conjugate binder fibres is that conventionally used in polyester fibrefill for example in the range 5 to 7 cm.

The number of crimps in both the hollow fibres and the solid binder fibres is also important since this property has a large influence on the packing density. On the one hand, the aim is to be able to pack the lowest possible quantity of fibres per unit of volume, but on the other hand it is necessary to guarantee a sufficient bonding or attachment together of the fibres. A better attachment effect is, of course, obtained with a higher number of crimps, but the bonded batt is less voluminous. On the other hand, a small number of crimps have a disadvantageous influence on the bonding of the batt. The best possible conditions we have found are achieved with numbers of crimps of from 35 to 40 per 10 cm. and a percentage crimp of between 20 and 30%.

A feature of the fibrefill blend of the invention is that all of the polyester fibres and the conjugate binder fibres in the blend are slickened with, for example, between 0.1% and 0.3% by weight of the fibre of a cured polysiloxane coating. Such a coating, which may be applied to the fibres at any convenient stage in their production, imparts a softness, drapability and down-like aesthetics to bonded batts produced from the blend. Furthermore such a coating is wash-resistant so that it is retained on the fibres dueing normal laundering. Suitable polysiloxane coating compositions are available commercially.

Another important feature of the fibrefill blend of the invention is that the hollow polyester fibres and the conjugate binding fibres have substantially the same density and decitex (and so diameter). When we refer to the density of the hollow polyester fibres we are referring to the overall density of the fibres including the cavity.

Also when we state that the hollow polyester fibres and the conjugate binding fibres have substantially the same density we mean that the density of one type of fibre should not differ from the density of the other type of fibre by more than or less than 10%.

When we state that the hollow polyester fibres and the conjugate binding fibres have substantially the same decitex we mean that the decitex of one type of fibre should not differ from the decitex of the other type of fibre by more than or less than 10%.

In practice the decitex of both types of fibre will lie in the range 2 to 15 .

In general, the components of the conjugate fibres can be selected from quite a wide variety of suitable materials in order to achieve a density match between the hollow fibres and the conjugate binder fibres. In practice, however, when the hollow fibres are of polyethylene terephthalate, we prefer that one of the components in the conjugate fibres is polyethylene terephthalate and the other component, having a lower softening temperature and lower density, is a polyolefine, in preference polypropylene.

It will, of course, be realised that as the cavity volume in the hollow fibres decreases, the proportion of the less dense component in the conjugate fibre will require to be decreased in order that a density match can be maintained. In particular when the hollow fibres are of polyethylene terephthalate (having a density of approximately 1.38) and the conjugate fibres, for example core/sheath fibres, are of polyethylene terephthalate (having a density of approximtely) 1.38) and polypropylene (having a density of approximately 0.91), a density match is achieved when there is a cavity volume of 30% in the hollow fibre by a combination in the conjugate fibres of 17% by weight of polyethylene terephthalate and 83% by weight of polypropylene. However, when the hollow fibres have a cavity volume of 10%, a density match is achieved if the conjugate fibres consist of a combination of 78.5% by weight of polyethylene terephthalate and 21.5% by weight of polypropylene.

Bonded batts made from the fibrefill blend of the invention offer a number of advantages over the bonded batts made hitherto, particularly those batts in which bonding is achieved through the medium of a resin. Edge cuts and other trimmings from such bonded batts may be reworked because the conjugate fibres therein will retain their bonding capability. The bonded batts of the invention also have softer, slicker and more drapeable properties than a resin bonded batt. In addition the bonded batt is toxicologically cleaner. Furthermore batts of the invention may be quilted and made up into garments with much neater seaming (probably due to the absence of polymer agglomerates) than resin bonded batts.

This invention will now be described with reference to the following Examples:

EXAMPLE 1

A non-woven web was produced from a blend of 80% 4.4 dtex 58 mm polyester hollow slickened fibre and 20% 4.4 dtex 58 mm polyester heterofil slickened fibre using a conventional carding process. The heterofil fibre is composed of 48% polyester core and 52% polypropylene sheath and has a linear density of 4.4 dtex and an actual density of 1.1 gm/cc. The hollow fibre is composed of 100% polyester having a void of 20% a linear density of 4.4 dtex and an actual density of 1.1 gm/cc. Both fibres were processed simultaneously and had a polysiloxane finish applied (ca 0.2% by weight of the fibre). Both fibres were mechanically crimped to give 3.5–4.0 crimps per cm and 25% crimp.

The non-woven web was cross lapped to give a wadding weight of 150 g/m$^2$ and the batt heat treated in a hot air oven for 30 seconds at 170° C. Air flow speed in the oven was in the order of 30 meters/min with an upflow/downdraught ratio of 2.1.

The resultant thermal bonded wadding had a specific volume of 250 cc/gm and a recovered specific volume, after loading at 24.3 g/cm$^2$ of 170 cc/gm.

EXAMPLE 2

A non-woven web was produced from a blend of 75% 4.4 dtex 58 mm polyester hollow slickened fibre and 25% 4.4 dtex 58 mm polyester heterofil slickened fibre using a conventional carding process. The heterofil fibre is composed 48% polyester core and 52% polypropylene sheath and has a linear density of 4.4 dtex and an actual density of 1.1 gm/cc. The hollow fibre is composed of 100% polyester having a void of 20% a linear density of 4.4 and an actual density of 1.1 gms/cc. Both fibres were processed simultaneously and had a polysiloxane finish applied (ca 0.2% by weight of fibre). Both fibres were mechanically crimped to give 3.5–4.0 crimps per cm and 25% crimp.

The non-woven web was cross lapped to give a wadding weight of 300 g/m$^2$ and the batt heat treated in a hot air oven for 30 seconds at 170° C. Air flow speed in the oven was in the order of 30 m/min with an upflow/-downdraught ratio of 2:1.

The resultant thermal bonded wadding had a specific volume of 210 cc/gm and a recovered specific volume of 160 cc/gm after loading at 24.3 g/cm$^2$.

EXAMPLE 3

A non-woven web was produced from a blend of 80% 13 dtex 65 mm polyester hollow slickened fibre and 20% 13 dtex 65 mm polyester heterofil slickened fibre using a conventional carding process. The heterofil fibre is composed of 48% polyester core and 52% polypropylene sheath and has a linear density of 13 dtex and an actual density of 1.1 gms/cc. The hollow fibre is composed of 100% polyester having a void of 20%, a linear density of 13 dtex and an actual density of 1.1 gm/cc. Both fibres were processed simultaneously and had a polysiloxane applied (ca 0.2% by weight of the fibre). Both fibres were mechanically crimped to give 3.5–4.0 crimps per cm and 25% crimp.

The non-woven web was cross lapped to give a wadding weight of 475 g/m$^2$ and the batt heat treated in a hot air oven for 30 secs at 170° C. Air flow speed in the oven was in the order of 30 meters/min with an upflow/downdraught ratio of 2:1.

The resultant thermal bonded wadding had a specific volume of 125 cc/gm and a recovered specific volume, after loading at 24.3 gm/cm$^2$, of 100 cc/gm.

What is claimed is:

1. A fibrefill blend comprising (a) from 90 to 50% by weight of slickened crimped hollow polyester fibre having a cavity volume of 10 to 30% and, complementally, to total 100% by weight, (b) from 10 to 50% by weight of slickened crimped conjugate fibre, the improvement being that the hollow polyester fibres and the conjugate binding fibres have substantially the same density and decitex (and so diameter) and that the conjugate fibre comprises a polyester core and a polyolefin sheath.

2. A thermally bonded batt formed from the fibrefill blend of claim 1.

* * * * *